US006857872B2

(12) United States Patent
Lonardi et al.

(10) Patent No.: US 6,857,872 B2
(45) Date of Patent: Feb. 22, 2005

(54) DEVICE FOR LOADING A SHAFT FURNACE

(75) Inventors: Emile Lonardi, Bascharage (LU); Giovanni Cimenti, Bertrange (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 10/481,909

(22) PCT Filed: Jun. 18, 2002

(86) PCT No.: PCT/EP02/06682

§ 371 (c)(1),
(2), (4) Date: Dec. 23, 2003

(87) PCT Pub. No.: WO03/002770

PCT Pub. Date: Jan. 9, 2003

(65) Prior Publication Data

US 2004/0224275 A1 Nov. 11, 2004

(30) Foreign Application Priority Data

Jun. 26, 2001 (LU) ..... 90794

(51) Int. Cl.[7] ..... C21B 7/10

(52) U.S. Cl. ..... 432/96; 266/197; 414/206

(58) Field of Search ..... 432/95, 96, 87, 432/77, 109; 266/197; 414/206

(56) References Cited

U.S. PATENT DOCUMENTS

| | | | | | |
|---|---|---|---|---|---|
| 4,273,492 | A | * | 6/1981 | Legille et al. | 414/160 |
| 4,526,536 | A | | 7/1985 | Legille et al. | |
| 5,252,063 | A | | 10/1993 | Thillen et al. | |
| 5,799,777 | A | * | 9/1998 | Mailliet et al. | 198/642 |

FOREIGN PATENT DOCUMENTS

| | | |
|---|---|---|
| DE | 3809533 | 10/1988 |
| WO | WO 99/28510 | 6/1999 |

* cited by examiner

*Primary Examiner*—Gregory Wilson
(74) *Attorney, Agent, or Firm*—McCormick, Paulding & Huber LLP

(57) ABSTRACT

A loading device for a shaft furnace comprises a chute supported by a suspension rotor (28) in a fixed housing. The rotor (28) is fitted with a cooling circuit, supplied with liquid coolant via a rotating annular joint (44). The latter comprises a fixed ring (60) and a rotating ring (62), and is fitted in an annular leak collecting tank (46) formed by the suspension rotor (28). Fixed ring (60) is supported by the housing (12). Rotating ring (62) is supported entirely by fixed ring (60) via a bearing (64). Selective coupling means (65, 66) connect the rotating ring (62) to the suspension rotor (28) in such a way as to transmit a rotary moment of rotor (28) to rotating ring (62) selectively, while at the same time preventing other forces from rotor (28) being transmitted to rotating ring (62).

9 Claims, 5 Drawing Sheets

DEVICE FOR LOADING A SHAFT FURNACE

CROSS-REFERENCE TO RELATED APPLICATIONS

This application is entitled to the benefit of and incorporates by reference in their entireties essential subject matter disclosed in International Application No. PCT/EP02/06682 filed on Jun. 18, 2002 and Luxembourg Patent Application No. 90 794 filed on Jun. 26, 2001.

FIELD OF THE INVENTION

The present invention concerns a loading device for a shaft furnace. More particularly, it concerns the cooling of a loading device for a shaft furnace, such as a blast furnace, comprising a housing to be mounted at the top of the shaft furnace, a suspension rotor suspended in such a way that it rotates on that housing, a loading chute suspended in the suspension rotor and at least one cooling circuit supported by the suspension rotor.

BACKGROUND OF THE INVENTION

In 1978, the company Paul Wurth S. A. proposed such a loading device, which is described in detail in U.S. Pat. No. 4,273,492. The suspension rotor in this device is fitted with a lower protective screen which surrounds the chute feed channel and protects the drive means mounted in the housing against the radiant heat from the inside of the shaft furnace in particular. To this end, the lower screen contains a cooling circuit which is supplied with liquid coolant via a rotating annular connection around the chute feed channel. This rotating connection comprises a rotating ring and a fixed ring. The rotating ring is an extension of the suspension rotor and forms an integral part of it, extending beyond of the housing. The fixed ring is fastened to the housing and the rotating ring has a clearance around the fixed ring. Two cylindrical roller bearings are fitted, designed to centre the rotating ring in the fixed ring. The fixed ring comprises two annular grooves one above the other, facing the external cylindrical surface of the rotating ring. Ports in the external cylindrical surface of the rotating ring facing the two grooves define the connection passages of the cooling circuit. Watertight fittings mounted along both sides of each groove abut the external cylindrical surface of the rotating ring to ensure that there are no leaks between the rotating ring and the fixed ring. In practice, it has emerged that a rotating joint of this kind is largely unsuitable for a shaft furnace. Indeed, to avoid cooling water leaking into the housing, it is essential to ensure that there are no leaks between the rotating ring and the fixed ring; but, in a shaft furnace, the effectiveness of the watertight fittings deteriorates rapidly, being as they are in contact with a very hot moving ring, which does nothing for their life cycle. Given the variable thermal expansion which occurs, the radial clearance between the rotating ring and the fixed ring varies considerably, which also has an adverse effect on the life cycle of the watertight fittings, and may even cause the rotating joint to seize up and be completely destroyed. It should also be noted that the life cycle of the rotating joint is affected by violent shocks which the suspension rotor with the chute inevitably absorbs. Lastly, it should be noted that such a large diameter rotating joint, fitted with watertight fittings, involves considerable levels of friction, which considerably increases the power required to start the chute moving. In conclusion, it emerges that a rotating joint of the type described in U.S. Pat. No. 4,273,492 has too many disadvantages to be a viable solution to feeding a cooling circuit mounted on a feed device for a rotary furnace.

To avoid all these disadvantages, as early as the company Paul Wurth S. A. proposed a cooling device for a loading system for a blast furnace without any watertight fittings. This cooling device, which is described in detail in U.S. Pat. No. 4,526,536, has been installed in numerous installations for loading blast furnaces throughout the world. It is characterised by an upper annular tank, which is mounted on an upper sleeve of the suspension rotor and which is fed with cooling water by gravity. A cooling water circuit is incorporated in the housing, and comprises one or more ports above the upper annular tank enabling cooling water to flow by gravity into the upper annular tank, which rotates together with the suspension rotor. The upper cooling tank is connected to a number of cooling coils installed on the suspension rotor. These coils have outlet pipes discharging into a lower annular tank which is fixed and cannot rotate, as it is mounted on the bottom of the housing. The water therefore flows by gravity from a fixed non-rotating supply into the upper annular tank of the suspension rotor, then passes under the influence of gravity into the annular housing tank and is then discharged from the housing. Water gauges in the two annular reservoirs enable the circulation of cooling water to be monitored. In the upper annular tank, the level is adjusted such that it remains between a minimum level and a maximum level at all times. If the level falls to the minimum level, the supply to the annular tank is increased to ensure the necessary supply to the coils. If the level rises to the maximum level, the supply to the annular tank is reduced to avoid the annular tank overflowing.

The first disadvantage of the 1982 cooling device is that the pressure available to move the cooling water through the cooling circuits is essentially governed by the difference in height between the upper tank and lower collecting tank. The suspension rotor must therefore be fitted with low-loss cooling circuits, which is a considerable disadvantage in terms of space occupied and/or cooling efficiency. In particular, there is a risk of local overheating due to the slow circulation speed of the cooling water in the cooling coils. A second disadvantage of the cooling device of 1982 is that the gases from the blast furnace come into contact with the cooling water already in the upper annular tank. As these blast furnace gases carry considerable quantities of dust, this dust inevitably passes into the cooling water. This dust forms sludge in the upper annular tank, which passes through the cooling coils and may block them up. The blast furnace gases also turn the cooling water acid, which tends to corrode the cooling circuits.

To create cooling circuits of higher capacity, it has been proposed, in patent application DE 3342572, to fit these circuits with an auxiliary pump mounted on the suspension rotor. This auxiliary pump is driven by a mechanism which converts the rotation of the suspension rotor into rotation of a drive shaft for the pump. It follows that the auxiliary pump only works when the rotor is rotating; and furthermore, such an auxiliary pump is rather sensitive to the sludge which passes through the cooling coils.

Patent application WO 99/28510 presents a method for cooling a loading device of the type described above, which is fitted with a rotating connection. Contrary to the doctrine of the state of the art, no attempt is made to ensure that the rotating connection is totally watertight, as required in U.S. Pat. No. 4,273,492, for example, nor to avoid leaks outside the rotating connection by a system of level controls, as specified in U.S. Pat. No. 4,526,536. Instead, it is proposed to provide a supply of liquid coolant to the rotating connection in such a way that a leakage flow passes into an annular separation slit between the rotating and fixed sections of the connection to form a liquid watertight fitting which prevents dust penetrating into the rotating connection. This leakage flow is then collected and drained off out of the housing, without passing through the cooling circuit. The result of this is that dust sludge no longer passes through the cooling circuit, and so does not risk clogging it up.

Patent application WO 99/28510 proposes a number of embodiments of the rotating annular connection. In a first embodiment, the fixed section is an annular block which is adjusted with clearance in an annular channel of the suspension rotor, such as to be separated from each of the cylindrical walls of that channel by an narrow annular radial slot. To reduce the leaks via these two annular radial slots, patent application WO 99/28510 proposes to provide each annular slot with one or more lipped watertight fittings or to design each annular slot as a labyrinth watertight fitting. One drawback with this method is that the annular channel in the suspension rotor has to be machined with great precision, and is therefore very expensive. The annular block must also be fitted very precisely in the annular channel of the suspension rotor. This also means that this method is highly prone to centring errors of the rotation of the suspension rotor, and to violent shocks absorbed by the suspension rotor. Another drawback is that the complete suspension rotor has to be removed to repair a damaged annular channel. In an alternative embodiment, the fixed section of the rotating joint consists of a fixed rotary ring, which rests axially, via two watertight fittings, on a ring mounted in an annular channel in the suspension rotor. This fixed rotary ring can slide vertically, such that it can be pressed against the ring mounted in the annular channel of the suspension rotor. This method is relatively vulnerable to variation in the plane of rotation of the suspension rotor. Such variations in the plane of rotation of the suspension rotor are hard to avoid, since the loads on the bearing ring supporting the suspension rotor in the housing are not generally symmetrical with respect to the axis of that rotation, and vary with the angular position of the loading chute.

In conclusion, more than twenty years after the date on which U.S. Pat. No. 4,273,492 was lodged, there is still no satisfactory solution to supplying rotary equipment in a loading device for a shaft furnace with a pressurised liquid coolant.

OBJECTS AND SUMMARY OF THE INVENTION

It will therefore be readily appreciated that the loading device of the present invention finally provides a satisfactory solution to the problem.

It should be recalled first of all that the loading device according to the invention is of the type which consists of a housing mounted at the top of a shaft furnace, a suspension rotor suspended in that housing in such a way that it can rotate, a loading chute suspended in the suspension rotor and at least one cooling circuit supported by the suspension rotor. This cooling circuit is fed by a liquid coolant through a rotating annular joint which is of the type consisting of: a fixed ring mounted in the housing, a rotating ring rotating with the suspension rotor and bearings between the fixed and rotating rings. In this rotating joint, the fixed and rotating rings together form a cylindrical interface in which one or more annular grooves transfer a pressurised liquid coolant between the fixed and rotating rings. The transfer of the liquid coolant from the rotating ring to the suspension rotor is then effected by connections between the rotating ring and suspension rotor. The device according to the invention is distinguished in particular by the characteristics which will be explained below. The rotating annular joint is mounted on the inside of the housing, in an annular tank for collecting leaks which is formed by the suspension rotor. Furthermore, the rotating ring of this rotating joint is mounted solely on the fixed ring by means of bearings. Selective coupling means couple this rotating ring, floating on the fixed ring, with the suspension rotor in such a way as to transmit the rotational motion of the suspension rotor to the rotating ring selectively, while at the same time preventing other forces from being transmitted from the suspension rotor to the rotating ring. Lastly, the connection means include a deformable tubular section, such that these connection means form a non-rigid connection between the rotating ring and the suspension rotor. It will be appreciated that, finally after twenty years, these characteristics provide a reliable solution to supplying rotating equipment of a loading device for a shaft furnace with pressurised liquid coolant. Indeed, in the solution according to the invention, the rotating joint does not cause any problems of leakage or of excessive friction, nor any problems with the life expectancy of the watertight fittings nor any problems of differential thermal expansion or problems of seizure. The rotating joint is not susceptible to the violent shocks that are inevitably absorbed by the suspension rotor holding the chute. Nor is it susceptible to rotor centering inaccuracies and variations in the plate of rotation of the suspension rotor. No special machining is required for the suspension rotor of the chute. The rotating joint can be replaced easily without removing the suspension rotor.

It will also be appreciated that the device according to the invention enables a cooling circuit supported by the suspension rotor to be integrated easily in a closed cooling circuit. To this end, it is sufficient to provide a first annular groove in the cylindrical interface to transfer liquid coolant from the fixed ring to the rotating ring, and a second annular groove in the cylindrical interface to transfer liquid coolant from the rotating ring to the fixed ring. This enables liquid coolant to pass back and forth through the rotating annular joint.

Alternatively, the cooling circuit or circuits may include one or more open outlet pipes. In this case, the housing might advantageously include a fixed annular tank for collecting liquid coolant into which the discharge passage or passages run when the suspension rotor is rotating. Drainage facilities are associated with the fixed annular tank for draining the liquid coolant out of the housing in a controlled fashion.

The drainage facilities are advantageously connected to the annular tank for collecting leaks to drain the leaks which the latter collect so they can be drained out of the housing in a controlled fashion.

In a preferred embodiment of the device according to the invention, the fixed ring of the rotating joint is supported by an annular flange which is fixed to the housing. The annular leak collecting tank then comprises upper edges which together with this annular flange form labyrinth watertight fittings. The rotating joint is therefore relatively well insulated from the rest of the housing.

The connection means advantageously include one or more flexible couplings, compressible axially, which are advantageously supported by the rotating ring and include a connecting head. This coupling head is associated with a coupling seat arranged in the annular leak collecting tank, so that the coupling head sits on the coupling seat when the rotating annular joint is fitted in the annular leak collecting tank. It will be appreciated that this method makes fitting and removing the rotating annular joint extremely easy.

The aforesaid connection means advantageously include a simple radial cross member mounted in the annular leak collecting tank of the suspension rotor and a notch in the rotating ring. This notch then engages the radial cross member when the rotating annular joint engages in the annular leak collecting tank.

The connecting means advantageously feed into an annular collecting tank fitted below the annular leak collecting tank. A number of cooling circuits supported by the suspension rotor are then connected to the annular collecting tank.

In a preferred embodiment, a pair of axially-spaced watertight fittings is mounted in the cylindrical interface, between an annular groove and the bearings, or between two adjacent annular grooves. A drain port drains the area of the cylindrical interface between the two watertight fittings of a pair of watertight fittings in the annular output collection tank.

BRIEF DESCRIPTION OF THE DRAWINGS

Other particular features and characteristics of the invention will emerge from the detailed description of a number of advantageous embodiments presented below, by way of illustration, and referring to the drawings attached.

DETAILED DESCRIPTION OF THE INVENTION

In the figures shown, item numbers which are the same indicate components which are similar or identical.

Figure 1:
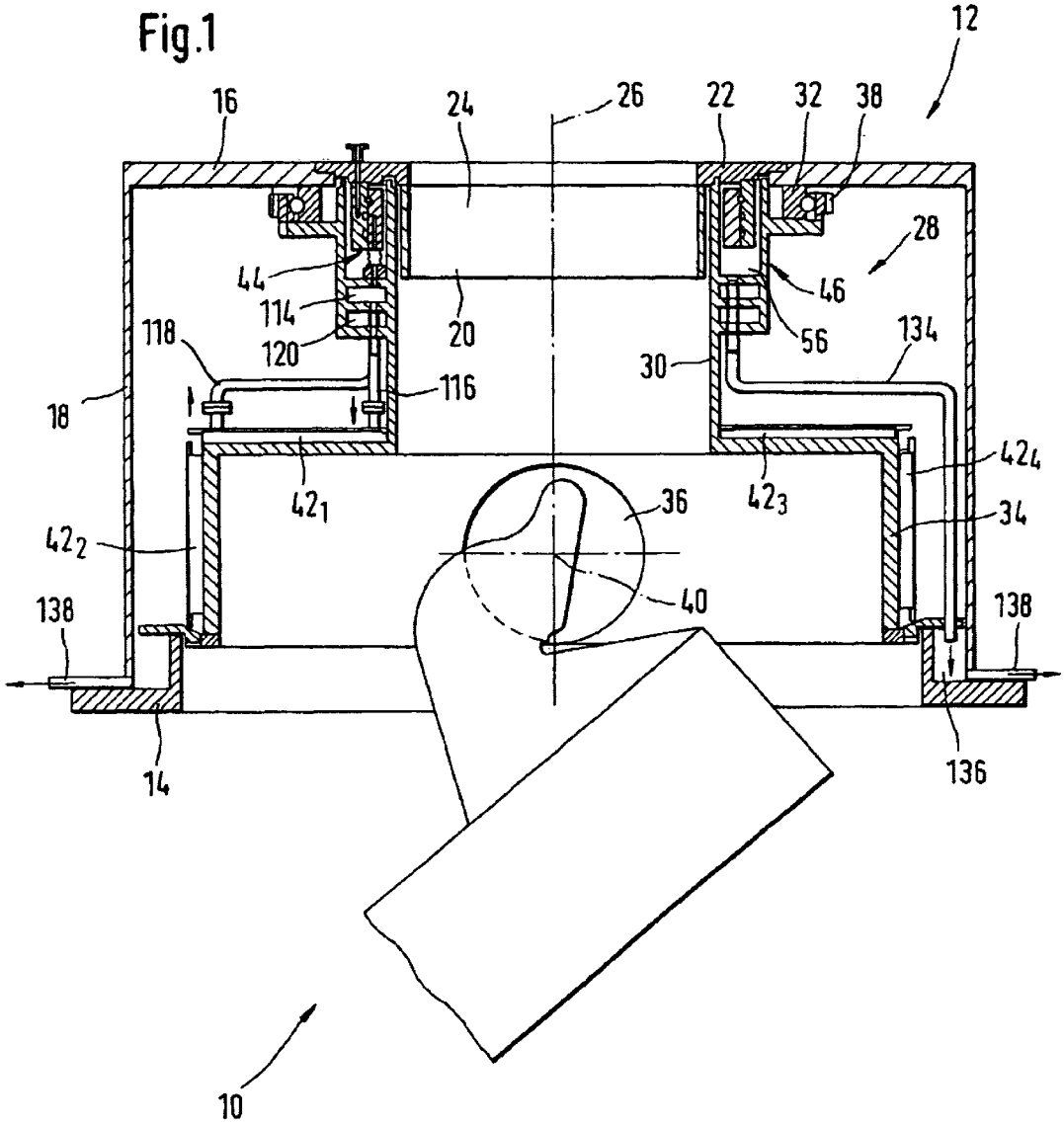
FIG. 1 is a vertical cross-section of a first embodiment of a loading device for a shaft furnace as per the invention.

FIG. 1 shows a loading device with a rotating chute 10, designed to be mounted on a shaft furnace, such as a blast furnace, in diagrammatic form.

This device consists of a housing 12 with an annular flange 14 at the bottom, a support plate 16 at the top and a side wall 18. The annular flange 14 connects the housing 12 to a mating flange (not shown) of a shaft furnace, to produce a watertight joint. The support plate 16 is connected to the bottom of a hopper or gate housing (not shown). Side wall 18 provides a watertight connection between flange 14 and supporting plate 16. A fixed feed sleeve 20 is mounted in a central opening of the support plate 16 by means of an annular flange 22. This fixed feed sleeve 20 extends into housing 12 to define a feed channel 24 for the material to be loaded into the shaft furnace. This feed channel 24 has a central axis 26 which is normally coincident with the centre line of the shaft furnace.

A suspension rotor 28 for chute 10 is mounted in housing 12. The upper end of this suspension rotor 28 forms a suspended sleeve 30, which surrounds the feed sleeve 20 and is suspended in housing 12 with the aid of a large-diameter bearing 32. The lower end of suspension rotor 28 forms a shield 34 in the central opening of the lower flange 14 of housing 12. It also supports the suspension bearings 36 for chute 10.

A motor (not shown) engages in a ring gear 38 on suspended sleeve 30 to drive the suspension rotor 28, and therefore chute 10 suspended in it, to rotate it around axis 26. Chute 10 is also usually fitted with a pivoting device (not shown), which allows-its-its angle of inclination to be varied by letting it pivot on its suspension bearings 36 around an axis 40 perpendicular to the axis of rotation 26 (in FIG. 1, axis 40 is perpendicular to the plane of the page).

Figure 2:
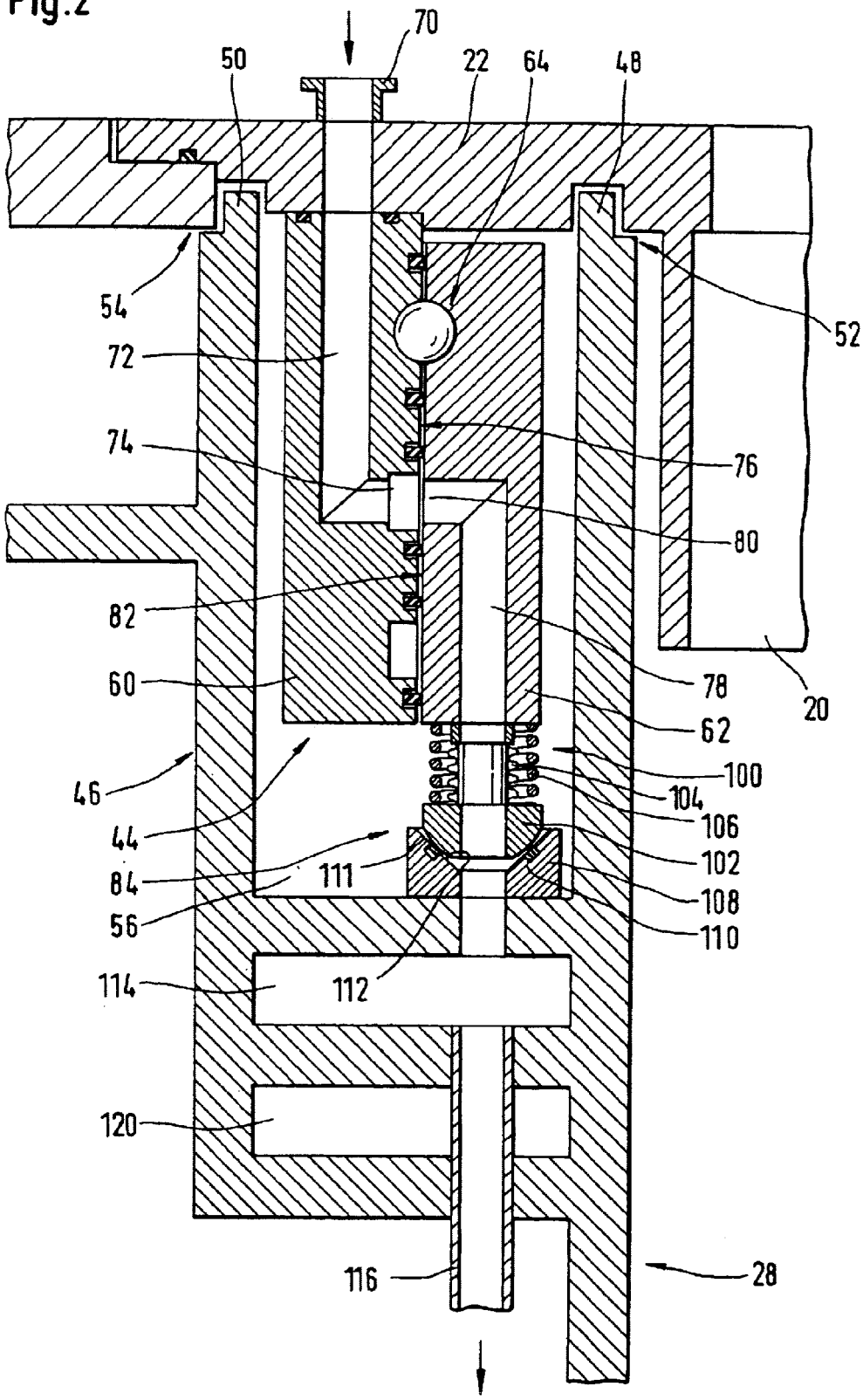
FIG. 2 is a vertical cross-section of a rotating annular joint fitted to the loading device for a shaft furnace as in FIG. 1.

To protect the shield 34 from the high temperatures found in a shaft furnace and to prevent these transmitting heat to the inside of housing 12, shield 34 is equipped with cooling circuits $\mathbf{42}_1$, $\mathbf{42}_2$, $\mathbf{42}_3$ and $\mathbf{42}_4$, in which liquid coolant, such as water, is circulated. These cooling circuits $\mathbf{42}_1$, $\mathbf{42}_2$, $\mathbf{42}_3$ and $\mathbf{42}_4$ advantageously contain baffles or tubes (not shown) which circulate the cooling water along a preset route along the walls of the shield 34. They are connected to a liquid coolant distribution circuit by means of a rotating annular joint, which is indicated throughout as item 44. The latter is fitted inside housing 12 in an annular leak collecting tank 46, which is formed by the upper end of the suspended sleeve 30 of suspension rotor 28. FIG. 2 shows that the two end faces 48, 50 of the annular leak collecting tank 46 form labyrinth watertight fittings 52, 54 together with annular flange 22. This results in what is almost a separate tank 56 inside housing 12, in which the rotating annular joint 44 is well protected from the fumes entering housing 12. To provide further protection, clean gas can be injected into this separate tank 56 so as to maintain it at an overpressure relative to the furnace.

Figure 3:
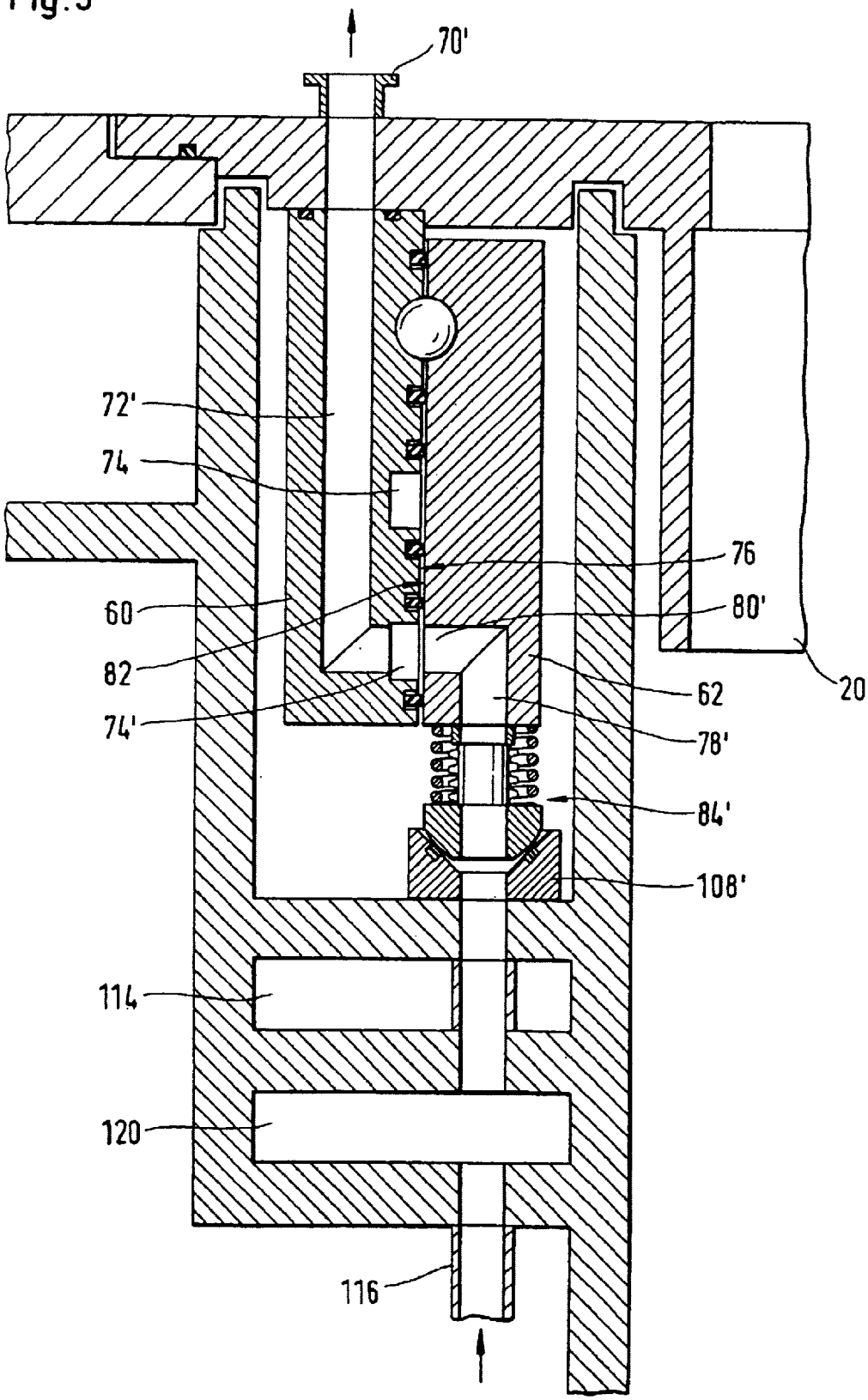
FIG. 3 is another vertical cross-section of the rotating annular joint fitted to the loading device for a shaft furnace as in FIG. 1.
Figure 4:
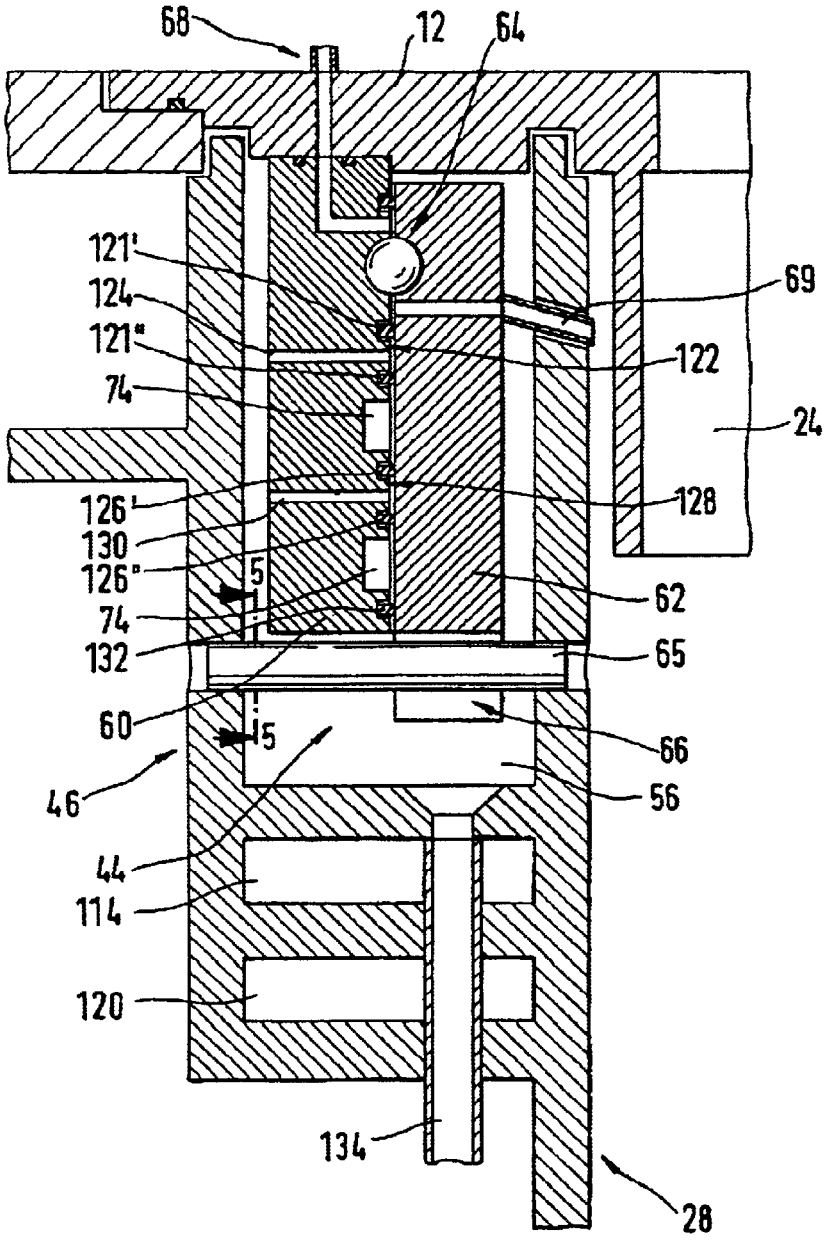
FIG. 4 is a further vertical cross-section of the rotating annular joint fitted to the loading device for a shaft furnace as in FIG. 1.

Rotating annular joint 44 will now be described in more detail, with the aid of FIGS. 2 to 5. It will be noted that FIGS. 2 to 4 represent vertical cross-sections at three different locations of rotating annular joint 44 in FIG. 1, showing respectively:

FIG. 2, the transfer of liquid coolant through rotating annular joint 44 to suspension rotor 28;

FIG. 3, the return of the liquid coolant from the suspension rotor through rotating annular joint 44;

FIG. 4, the mechanical coupling between rotating annular joint 44 and the suspension rotor, its lubrication, and the flow control.

Figure 5:
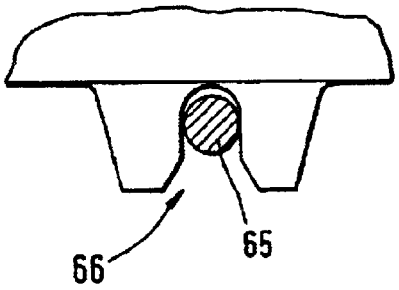
FIG. 5 is a cross-section along the line 5—5 in FIG. 4.

Looking at FIG. 4 first, the mechanical design of the rotating annular joint 44 is described briefly. It consists of a fixed ring 60 bolted to the underside of flange 22, and a rotating ring 62 mounted on fixed ring 60 with some radial play. It should be noted that rotating ring 62 is supported only by fixed ring 60 by means of a bearing 64. In fact, there is no rigid connection between rotating ring 62 and suspension rotor 28, although selective coupling means connect rotating ring 62 to suspension rotor 28 in such a way as to transmit the rotary motion of suspension rotor 28 to rotating ring 62 selectively, while at the same time preventing other movements of suspension rotor 28 from being transmitted to rotating ring 62. One particularly simple embodiment of these coupling means is illustrated in FIGS. 4 and 5. This is a radial cross member 65 which is mounted in the annular leak collecting tank 46 and which engages with a notch 66 in rotating ring 62, when rotating annular joint 44 is mounted in annular leak collecting tank 46. It will be appreciated that the radial cross member 65 and notch 66 together transmit the rotary moment of suspension rotor 28 to rotating ring 62, while at the same time allowing these two components to move relative to one another both vertically and radially. This renders rotating annual joint 44 virtually insensitive to thermal expansion, shock, vibration and fitting defects affecting suspension rotor 28. Another point to note is that the item number 68 is used throughout to indicate a pressurised lubricating circuit to bearing 64. Excess lubricant is discharged below bearing 64 into the feed channel 24 through a drain passage 69.

Referring to FIG. 2, the manner in which liquid coolant is passed to suspension rotor 28 via rotating annular joint 44 will now be described in more detail. Item 70 is a connection for a supply pipe for a pressurised liquid coolant. An internal passage 72 in fixed ring 60 links this connection 70 to an annular groove 74 which is arranged in the concave cylindrical surface 76 of fixed ring 60. An internal passage 78 in rotating ring 62 is connected to a port 80 in the convex cylindrical surface 82 of rotating ring 62 opposite annular groove 74. This internal duct 78 leads to a coupling 84 at the lower end face of rotating ring 62.

To summarise, the pressurised liquid coolant supplied to connection 70 passes through fixed ring 60 along internal passage 72 to annular groove 74, then crosses a cylindrical interface formed by the two cylindrical surfaces 76, 82, and enters the first port 80 in rotating ring 62. In the latter, the liquid coolant passes along internal duct 78 to coupling 84.

Remaining with FIG. 2, it will be noted that coupling 84 projects axially in relation to the lower end face of rotating ring 62. It includes a tubular component 100, flexible laterally and compressible axially, one end of which is fixed in the lower end face of rotating ring 62. The other end is fitted with a coupling head 102. Tubular component 100 includes a bellows expansion joint 104, surrounded by a helical compression spring 106. Coupling head 102 is associated with coupling seat 108, which is mounted on the base of the annular leak collecting tank 46 in such a way that when rotating annular joint 44 is mounted in annular leak connecting tank 46, coupling head 102 fits on the coupling seat. It will be noted that compression spring 106 provides sufficient contact pressure between connecting joint 102 and coupling seat 108, so that gasket 110, placed either on the spherical convex crown 111 of coupling head 102 or the conical concave crown 112 of coupling seat 108, provides a watertight joint between the two elements of the coupling. It remains to note that coupling seat 108 could also be located on rotating ring 62. In that case, coupling 84 would project axially in from the base of the annular leak collecting tank 46. Finally, coupling head 102 could be fitted with a conical concave crown and the connecting seat, with a spherical convex crown, which when coupled together would ensure a watertight connection with or without a gasket.

After the first coupling 84, the pressurised liquid coolant enters an annular supply collecting tank 114 via coupling seat 108. [Collecting tank 114] is arranged immediately below annular tank 56. Supply pipes for cooling circuits $\mathbf{42}_1$, $\mathbf{42}_2$, $\mathbf{42}_3$ and $\mathbf{42}_4$, mounted on suspension rotor 28, are connected to this supply collecting tank 114 in suspension rotor 28. FIG. 1 shows the supply pipe 116 which feeds cooling circuit $\mathbf{42}_1$, as an example.

Looking at FIG. 1, it will be seen that the liquid coolant leaves cooling circuit $\mathbf{42}_1$ via a return pipe 118, which discharges into a second annular collecting tank 120 mounted immediately below the first annular collecting tank 114.

Turning to FIG. 3, we will now describe in more detail how the liquid coolant returns via rotating annular joint 44. The second annular collecting tank 120 acts as a collecting tank for all cooling circuit returns $\mathbf{42}_1$, $\mathbf{42}_2$, $\mathbf{42}_3$ and $\mathbf{42}_4$. It is connected to an internal passage 78' in rotating ring 62 by the assembly of coupling 84'+coupling seat 108', which is of the same type as the assembly 84/108 described above. From this passage 78', the liquid coolant passes in the opposite direction to that described above through a port 80' and the cylindrical interface 76, 82, into a second annular groove 74' arranged in the concave cylindrical surface 76 of fixed ring 60. In this fixed ring 60, the liquid coolant passes along an internal passage 72' to the fixed connection 70' and then to a pressurised liquid coolant return pipe.

Turning back to FIG. 4, we will now describe the leak control in more detail. It will be noted first that the radial clearance between the fixed ring 60 and rotating ring 62 is relatively large, to reduce the risk of the two rings 60, 62 seizing. Accordingly, the axial leakage across the cylindrical interface 76, 82 is also relatively large; but this flow is controlled by the watertight fittings and drain passages. A first pair of watertight fittings 121', 121" is mounted in the cylindrical interface 76, 82 between the first groove 74 and bearing 64. These two watertight fittings 121', 121" are spaced axially apart from each another, and the area 122 of the cylindrical interface 76, 82 between the two watertight fittings 121', 121" is drained into the annular leak collecting tank 46 by drain passage 124. As the pressure in the lubrication circuit 68 is greater than at the area 122 of the cylindrical interface 76, 82, this ensures that the liquid coolant cannot penetrate into bearing 64. A second pair of watertight fittings 126', 126", is mounted at the cylindrical interface 76, 82, between the first groove 74 and second groove 74'. The area 128 of the cylindrical interface 76, 82 located between the two watertight fittings 126', 126" is drained into the annular leak collecting tank 46 by a drain passage 130. Since the pressure at area 128 of the cylindrical interface 76, 82 is less than the pressure in the second groove 74', this ensures that the liquid coolant flow cannot be short-circuited through the cylindrical interface 76, 82 from the first groove 74, where the supply pressure prevails, to the second groove 74', where the return pressure, which is significantly lower than the feed pressure, prevails. A final watertight fitting 132 is located in at the cylindrical interface 76, 82 below the second groove 74'. The leakage flow across this watertight fitting 132 is drained across cylindrical interface 76, 82 into the annular leak collecting tank 46. To summarise, the watertight fittings 121', 121", 126', 126" and 132 are not there to prevent leaks completely but to keep them within reasonable limits and channel them in a controlled fashion to the annular leak collecting tank 46. It follows that watertight fittings 121', 121", 126', 126" and 132 are always well cooled and lubricated, which increases their life cycle considerably and avoids seizures. The power required to make rotating ring 62 turn within fixed ring 60 is also reduced considerably as a result.

Item 134 refers to a drain pipe which is used to drain the leaks which collect in the annular leak collecting tank 46. FIG. 1 shows that this drain pipe 134 leads into a fixed annular tank 136 which is arranged at the bottom of housing 12. When the suspension rotor is rotating, the free end of drain pipe 134 discharges into fixed annular tank 136. It should also be noted that drainage means are associated with fixed annular tank 136 to drain the liquid coolant out of housing 12 in a controlled fashion. In FIG. 1, these drainage means are represented schematically by pipes 138.

Figure 6:
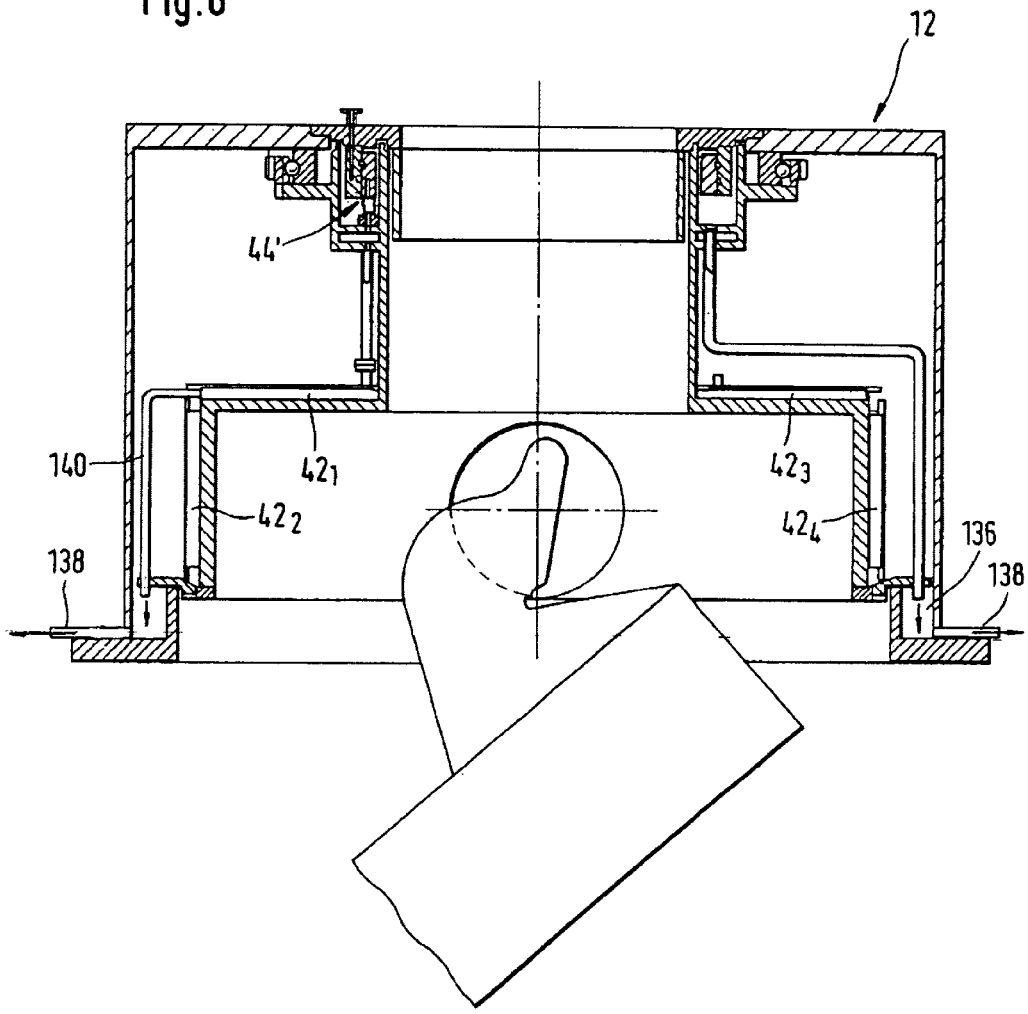
FIG. 6 is a vertical cross-section of a second embodiment of a loading device for a shaft furnace as per the invention.

FIG. 6 shows a simplified version of the device in FIG. 1. In this simplified version, the liquid coolant return from cooling circuits $\mathbf{42}_1$, $\mathbf{42}_2$, $\mathbf{42}_3$, $\mathbf{42}_4$ does not pass through the rotating annular joint 44, but is drained via open drainage pipes into fixed annular tank 136 situated at the bottom of housing 12. FIG. 6 shows drainage duct 140 of cooling circuit 42, as an example. It follows that rotating annual joint 44' only needs one annular groove and internal passages to transfer the pressurised liquid coolant between the fixed and rotating rings. The drawback with this system is that the liquid coolant in fixed annular tank 136 is exposed to the atmosphere prevailing in housing 12. This involves a more expensive treatment of the coolant water before returning it to the cooling system.

What is claimed is:

1. A loading device for a shaft furnace, comprising:

a housing to be mounted on the head of the shaft furnace;

a suspension rotor rotationally suspended within said housing;

a loading chute suspended in said suspension rotor;

at least one cooling circuit supported by said suspension rotor;

an annular rotating joint mounted inside said housing to supply said cooling circuit with a liquid coolant, said annular rotating joint being located in an annular leak collecting tank formed by said suspension rotor, and said annular rotating joint comprising:

a fixed ring, supported by said housing, a rotating ring which rotates with said suspension rotor, and bearing means arranged between said fixed ring and said rotating ring, wherein said fixed ring and said rotating ring interact to form a cylindrical interface in which at least one annular groove serves to transfer a pressurised liquid coolant between said fixed ring and said rotating ring, and wherein said rotating ring is supported exclusively by said fixed ring by way of said bearing means; and selective coupling means coupling said rotating ring to said suspension rotor in such a way as to selectively transmit the rotary motion of said suspension rotor to said rotating ring, while at the same time preventing the transmission of other forces from said suspension rotor to said rotating ring; and connecting means connected between said rotating ring and said suspension rotor to transfer a liquid coolant from said rotating ring to said suspension rotor, said connecting means comprising at least one deformable tubular component, such that said connecting means forms a non-rigid connection between said rotating ring and said suspension rotor.

2. The device as claimed in claim 1, further comprising:

a first annular groove in said cylindrical interface to transfer a liquid coolant from said fixed ring to said rotating ring; and a second annular groove in said cylindrical interface to transfer a liquid coolant from said rotating ring to said fixed ring.

3. The device as claimed in claim 1, wherein:

said at least one cooling circuit comprises at least one outlet pipe;

said housing comprises a fixed annular tank for collecting the liquid coolant;

said outlet pipe leads into said fixed annular tank when said suspension rotor is rotating; and a drainage means is associated with said fixed annular tank to drain the liquid coolant out of the housing.

4. The device as claimed in claim 1, wherein said annular leak collecting tank comprises a drainage means to drain liquid coolant leaks collected therein in a controlled fashion out of said housing.

5. The device as claimed in claim 1, wherein:

said fixed ring is supported by an annular flange fixed to said housing; and said annular leak collecting tank comprises top ends that interact with said annular flange to form labyrinth joints.

6. The device as claimed in claim 1, wherein said connecting means comprises:

at least one flexible, axially compressible coupling connection, which is supported by said rotating ring and comprises a coupling head and a coupling seat;

said coupling seat being arranged in said annular leak collecting tank, in such a way that said coupling head sits on said coupling seat, when said rotating annular joint is mounted in said leak collecting tank.

7. The device as claimed in claim 1, wherein said coupling means comprises:

a radial cross member mounted in said annular leak collecting tank of the suspension rotor; and a notch in said rotating ring which engages with said radial cross member when said rotating annular joint is fitted in said annular leak collecting tank.

8. The device as claimed in claim 1, wherein:

said connecting means leads into an annular collector fitted above said annular leak collecting tank; and several cooling circuits supported by said suspension rotor are connected to said annular collector.

9. The device as claimed in claim 1, further comprising:

a pair of axially spaced watertight fittings, said pair of watertight fittings being fitted in said cylindrical interface between an annular groove and said bearing means or between two adjacent annular grooves; and a drainage channel capable of draining the cylindrical interface between the two watertight fittings of a pair of watertight fittings in said annular leak collecting tank.

* * * * *